United States Patent [19]

Oztekin

[11] 4,055,253

[45] Oct. 25, 1977

[54] MERCHANDISE DISPLAY UNIT

[76] Inventor: Muammer A. Oztekin, P.O. Box 6247A, Birmingham, Ala. 35217

[21] Appl. No.: 707,231

[22] Filed: July 21, 1976

[51] Int. Cl.[2] ..... A47B 9/14

[52] U.S. Cl. ..... 211/189; 108/108; 108/111; 211/182

[58] Field of Search ..... 211/189, 186, 187, 190, 211/191, 182; 52/493; 108/108, 109, 64, 111; 403/405, 335, 338

[56] References Cited

U.S. PATENT DOCUMENTS

| | | | |
|---|---|---|---|
| 3,044,632 | 7/1962 | Schild | 108/108 X |
| 3,081,718 | 3/1963 | Schoffner | 108/108 |
| 3,164,230 | 1/1965 | Adams | 52/493 X |
| 3,209,709 | 10/1965 | Shoffner | 108/108 X |
| 3,263,821 | 8/1966 | Klene et al. | 108/108 X |
| 3,271,918 | 9/1966 | Phillips | 52/493 |
| 3,358,848 | 12/1967 | Johnsson | 211/190 |
| 3,415,030 | 12/1968 | Phillips | 52/493 |
| 3,461,630 | 8/1969 | Lovullo | 52/493 |
| 3,530,625 | 9/1970 | Ollinger | 52/493 X |
| 3,601,256 | 8/1971 | Bowers et al. | 108/108 X |

FOREIGN PATENT DOCUMENTS

| | | | |
|---|---|---|---|
| 224,853 | 12/1962 | Austria | 211/191 |

*Primary Examiner*—Roy D. Frazier
*Assistant Examiner*—Robert W. Gibson, Jr.
*Attorney, Agent, or Firm*—Woodford R. Thompson, Jr.

[57] ABSTRACT

A merchandise display unit having a pair of spaced uprights connected to adjacent ends of parallel shoe members which extend normal to and terminate adjacent an upstanding side plate. Parallel clips are carried by the outer end of each shoe member with the inner surfaces of the clips having upstanding recesses therein which face each other. An inturned flange carried by each end of the side plate passes between the parallel clips and is provided with a laterally extending projection which snaps into the adjacent upstanding recess in the adjacent clip. The uprights are detachably connected to each other by a tie bar having channel-like end portions with lateral slots therein which engage T-shaped slots in the uprights.

5 Claims, 4 Drawing Figures

Fig 1
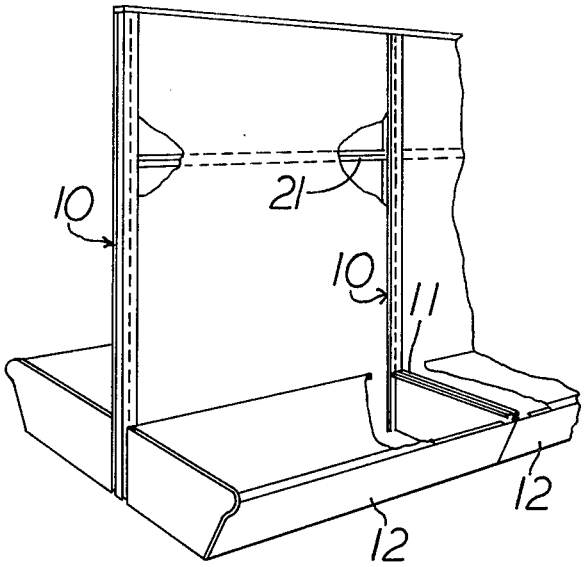
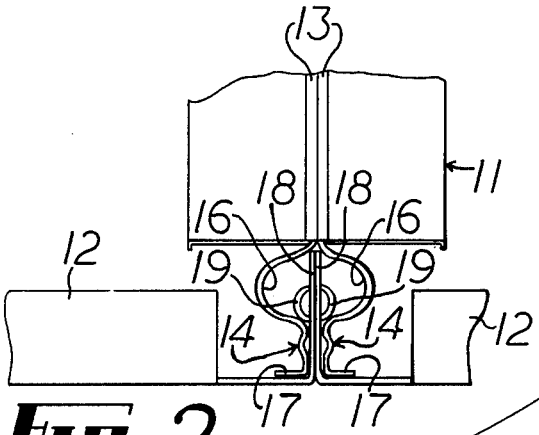
Fig 2
Fig 3
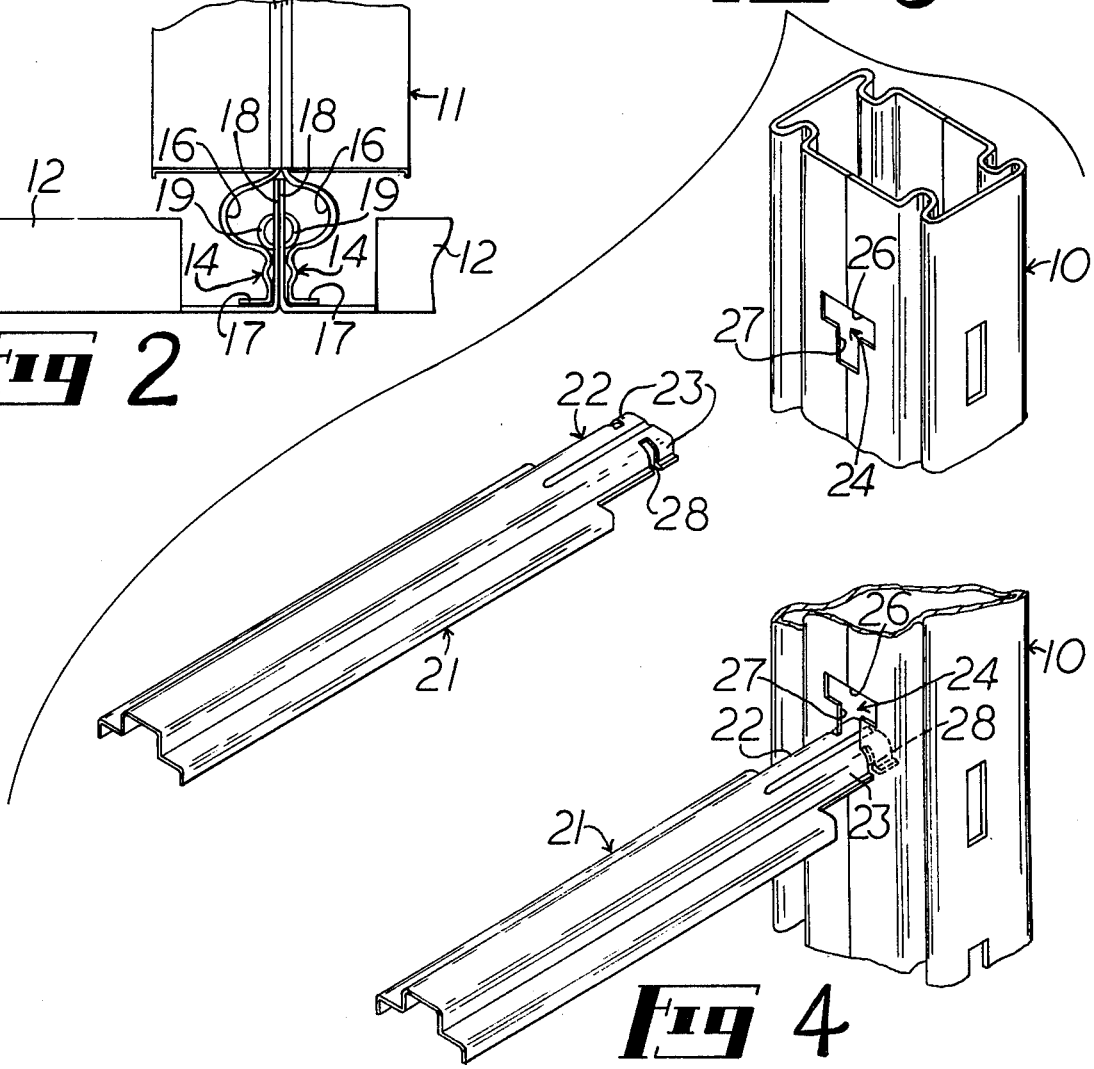
Fig 4

MERCHANDISE DISPLAY UNIT

BACKGROUND OF THE INVENTION

This invention relates to a merchandise display unit of the general type disclosed in my co-pending application Ser. No. 659,535, filed Feb. 19, 1976 and entitled "DETACHABLE END PLATFORM FOR MERCHANDISE DISPLAY UNIT".

As is well known in the art to which my invention relates, difficulties have been encountered in assemblying and disassemblying merchandise display stands due due to the fact that a considerable amount of time and effort is required to attach the various components of the display stands to each other. It is very desirable to assemble the display stand whereby the side plates may be readily removed and replaced whereby the floor area beneath the display stand may be maintained in a clean condition at all times. Also, the provision of the side plate adjacent the floor reduces the amount of dust, debris and the like which passes therebeneath.

BRIEF SUMMARY OF THE INVENTION

In accordance with my invention, I provide a merchandise display unit embodying a pair of spaced apart uprights which are detachably connected to each other by a tie bar having channel-like end portions with lateral slots therein which engage T-shaped slots in the uprights. Parallel, spaced apart shoe members are detachably connected to the uprights and extend perpendicular to upstanding side plates with the outer end of each shoe member terminating adjacent one end of the side plates. A pair of parallel clip-like members are carried by the outer end of each shoe member with the inner surfaces of the clip-like members having upstanding recesses which face each other and engage lateral projections carried by inturned flanges at the ends of the side plate with the flanges being disposed to pass between the clip-like members. The laterally extending projections thus snap into engagement with the adjacent upstanding recess in the clip member so that the inturned flange is detachably connected to the clip-like member and at the same time the flange and the side plate attached thereto are adapted to be moved to selected vertical positions whereby the side plate may be positioned closely adjacent the floor to prevent the passage of dust, debris and the like beneath the side plate. Accordingly, the side plate may be easily and quickly attached to and removed from the adjacent shoe member and at the same time the uprights may be easily and quickly attached to each other by the elongated tie bar which is detachably connected to the uprights.

A merchandise display unit embodying features of my invention is illustrated in the accompanying drawing, forming a part of this application, in which:

FIG. 1 is a perspective view, partly broken away;

FIG. 2 is an enlarged, fragmental, plan view showing the detachable connection between the shoe member and the adjacent ends of the side plates;

FIG. 3 is an enlarged, exploded view showing a part of the upright and the adjacent end of the tie bar, prior to attachment of the tie bar to the upright; and, FIG. 4 is a fragmental view, showing the manner in which the end of the tie bar is attached to the adjacent part of the upright having the T-slot therein.

DETAILED DESCRIPTION

Referring now to the drawing for a better understanding of my invention, I show a pair of spaced apart uprights 10 which are detachably connected by suitable means to the adjacent ends of parallel, spaced apart shoe members 11 which extend generally perpendicularly to an upstanding side plate 12 with the outer end of each shoe member 11 terminating adjacent the ends of the side plates 12, as shown in FIG. 2. Each shoe member 11 comprises a pair of adjacent, parallel plates 13 which are rigidly secured to each other by suitable means, such as by spot welding or the like. The outer end of each of the parallel plates forming the shoe member 11 carries a clip-like member 14. As clearly shown in FIG. 2, each clip-like member 14 is provided with an upstanding recess 16 therein. That is, the recesses 16 extend in a generally vertical direction and all the way across the clip-like member 14, as shown in FIG. 2. The outermost ends of the clip-like members 14 are turned outwardly as at 17, as shown.

Each side plate 12 is provided with an inturned flange 18 which is adapted to pass between the clip-like members 14, as shown in FIG. 2. A plurality of vertically spaced projections 19 are provided on the inturned flanges 18 in position to snap into an adjacent upstanding recess 16 in the clip member 14 whereby the inturned flange 18 is attached to the clip-like member and its shoe member 11. While I have only shown one laterally extending projection 19, I prefer to form several of the projections 19 in spaced relation to each other along the inturned flanges 18. Such projections may be punched out sections from the inturned flange 18. Preferably, the clip-like members 14 are integral end portions of the adjacent parallel plates 13 which form the shoe member 11. Also, the upstanding recesses 16 are preferably generally semi-cylindrical, as viewed in cross section and the projections 19 are generally semi-cylindrical, as viewed in cross section whereby they readily snap into the recesses 16, as shown in FIG. 2. Inward movement of the side plates 12 is limited by the outturned flanges 17 carried by the clip member 14.

As shown in FIG. 1, the uprights 10 are connected to each other by a horizontal tie bar 21 which extends between the uprights 10, which are hollow, as shown in FIGS. 3 and 4. Each end of the tie bar 21 is in the form of a generally channel-shaped member 22 having depending flanges 23. T-shaped slots 24 are provided in the sides of the uprights 10 which face each other with each of the T-slots having an upper horizontal portion 26 of a size to receive the channel-shaped end member 22 and a subjacent vertical portion 27 connected to the horizontal portion 26, as shown in FIGS. 3 and 4. Oppositely disposed, outwardly opening slots 28 are provided in the depending flanges 23 of the channel-shaped member 22 in position to receive the adjacent portions of the hollow upright 10 adjacent the vertical portions 27 of the T-shaped slots, as shown in FIG. 4. Accordingly, the tie bar 21 may be readily attached to the upright 10 by merely inserting the channel-shaped member 22 into the horizontal portion 26 of the slot 24 and then moving the same downwardly whereupon the slots 28 receive the portions of the hollow upright 10 adjacent the vertical portions 27 of the T-shaped slots 24 whereby the end of the tie member 21 is firmly attached to the upright 10.

From the foregoing description, the manner in which my improved merchandise display unit is assembled will be readily understood. The uprights 10 are secured to each other by the elongated tie bar 21 by inserting the channel-like member 22 into the transverse portion 26 of the slot 24 until the slots 28 are in position to receive the adjacent portion of the hollow upright along the vertical portions 27 of the slot 24. Upon moving the tie bar 21 downwardly, the channel-shaped member 21 is locked firmly to the upright 10. The shoe members 11 are detachably connected to the lower portions of the uprights 10 in a manner well understood in the art to which my invention relates. With the shoe members 11 extending parallel to each other, the side plates 12 are positioned, as shown in FIG. 2, whereby the inturned flanges 18 thereof pass between the clip members 14. As the rounded projections 19 enter the recesses 16, the side plates 12 engage the outturned flanges 17 on the clip members 14 whereby the side plates are firmly attached to the shoe members. The side plates may be adjusted upwardly and downwardly relative to the adjacent ends of the shoe members due to the fact that the projections 19 ride in the upstanding recesses 16. Accordingly, the side plates may be positioned at any desired level relative to the floor. Preferably, the side plates are positioned in contact with the floor whereby dust, debris and other foreign materials cannot enter the space beneath the display stand.

From the foregoing, it will be seen that I have devised improved means for detachably connecting the various components of a merchandise display stand to each other. By providing the quick connection between the tie bar and the uprights, the uprights may be readily attached to each other in a minimum of time. Also, by providing means for detachably connecting the ends of the side plates to the ends of the shoe members, together with means for adjusting the vertical position of the side plates, the side plates may be positioned at the desired level relative to the floor to prevent the entry of dust and the like beneath the display unit. Also, the side plates may be readily removed from the shoe members whereby the area beneath the display unit may be mopped or cleaned by other suitable means.

While I have shown my invention in but one form, it will be obvious to those skilled in the art that it is not so limited, but is susceptible of various changes and modifications without departing from the spirit thereof.

I claim:

1. A merchandise display unit embodying a pair of spaced apart uprights detachably connected to adjacent ends of parallel, spaced apart shoe members which extend generally perpendicular to at least one upstanding side plate with the outer end of each said shoe member terminating adjacent one end of said side plate, the improvement comprising:

a. adjacent parallel plates defining a shoe member with each of the plates having a clip-like member formed integrally with the outer end thereof with the inner surfaces of adjacent clip-like members having upstanding recesses therein which face each other, b. an inturned flange-like member carried by each end of said side plate and disposed to pass between said adjacent clip-like members, and c. at least one laterally extending projection carried by said inturned flange-like member in position to snap into an adjacent upstanding recess between adjacent clip-like members so that said inturned flange-like member is attached to said clip-like members.

2. A merchandise display unit as defined in claim 1 in which said upstanding recesses are generally semi-cylindrical, as viewed in horizontal cross section.

3. A merchandise display unit as defined in claim 1 in which a plurality of said projections are carried by said inturned flange-like member in longitudinally spaced relation to each other.

4. A merchandise display unit as defined in claim 3 in which said projections are punched out sections from said inturned flange-like member.

5. A merchandise display unit as defined in claim 1 in which said uprights are hollow and are detachably connected to each other by means comprising:

a. an elongated tie bar extending between said hollow uprights with each end of said tie bar being in the form of a generally channel-shaped member having depending flanges, b. T-shaped slots in the sides of said uprights which face each other with each of said T-shaped slots having an upper horizontal portion of a size to receive said channel-shaped member and a subjacent vertical portion connected to said horizontal portion, and c. oppositely disposed, outwardly opening slots in said depending flanges of said channel-shaped member in position to receive portions of said hollow upright adjacent the vertical portions of said T-shaped slots.

* * * * *